US005820485A

United States Patent [19]

Hwang

[11] Patent Number: 5,820,485

[45] Date of Patent: Oct. 13, 1998

[54] MULTILAYER GOLF BALL HAVING PROJECTIONS ON THE SURFACE OR ITS INNER COVER

[75] Inventor: In Hong Hwang, Seoul, Rep. of Korea

[73] Assignee: Ilya Co. Ltd., Seoul, Rep. of Korea

[21] Appl. No.: 840,379

[22] Filed: Apr. 29, 1997

[30] Foreign Application Priority Data

Feb. 10, 1997 [KR] Rep. of Korea ..... 1997 3908

[51] Int. Cl.[6] ..... A63B 37/12

[52] U.S. Cl. ..... 473/361; 473/365; 473/376; 473/378; 473/370

[58] Field of Search ..... 473/355, 370, 473/374, 361, 365, 376, 378, 385

[56] References Cited

U.S. PATENT DOCUMENTS

| | | | |
|---|---|---|---|
| 704,748 | 7/1902 | Kampshall | 473/373 |
| 743,105 | 11/1903 | Roger | 473/374 X |
| 790,252 | 5/1905 | Mahaut | 473/374 |
| 1,482,232 | 1/1924 | Hazeltine | 473/355 X |
| 1,855,448 | 4/1932 | Hazeltine | 473/374 |
| 5,692,973 | 12/1997 | Dalton | 423/374 |

*Primary Examiner*—George J. Marlo
*Attorney, Agent, or Firm*—Amster, Rothstein & Ebenstein

[57] ABSTRACT

The present invention refers to a golf ball having projections in a form of dome, in a form of cut sphere, in a form of polyhedron, in a form of spherical polyhedron, in a form of which the base is in polygon and the sides are round and plane like the side of cut cone, in a form of which the base is in circle and the sides are round and plane like the side of cut cone or with a small dome put on each of cut top. The surface of the said inner cover can be made of projections of one kind on the whole or projections of a different kind. Meanwhile, it is possible to make the projections of one kind or more than two kinds that are different in a size or height. The said projections also may be apart from each other at regular intervals or may be in contact with each other, and in some cases, some projections may be in contact and some projections apart from each other. When hitting a golf ball having the projections on the surface of inner cover, the energy from outer cover can be transmitted to the inside of core by the said projections faster than other common golf balls having inner cover in a fixed thickness, so as to extend the carry and also having a good spin property.

14 Claims, 9 Drawing Sheets

MULTILAYER GOLF BALL HAVING PROJECTIONS ON THE SURFACE OR ITS INNER COVER

FIELD OF THE INVENTION

The structures of golf ball proper to the present invention are multilayer golf balls such as three piece solid golf ball with one core, inner cover and outer cover, four piece solid golf ball with dual core of inner core and outer layer covering the said inner core and double cover of outer cover and inner cover covering the dual core, four piece solid golf ball with one core and 1'st inner cover, inner cover, outer cover successively covering the core, five piece solid golf ball with dual core and triple cover, four piece golf ball with liquid core or solid core on which rubber thread is wound and double cover over it. When hitting a golf ball having projections on the surface of its inner cover, the energy from the clubhead will be transmitted to the inside of core through the cover by the aforementioned projections faster than other common golf balls with inner cover having fixed thickness do, so as to extend the carry by high repelling force in hitting the golf ball with a driver and to improve the spin property by discrepancy in hardness between inner cover and outer cover in hitting with an iron.

BACKGROUND OF THE INVENTION

Golf balls can be classified by the structure. There are many kinds of golf balls such as one piece golf ball in single structure, two piece golf ball with core and cover covering the core, three piece solid golf ball with dual core of inner core and outer layer covering the inner core and a cover covering the said dual core, three piece wound golf ball with a liquid core or a solid core on which rubber thread is wound and a cover over it, three piece solid golf ball with one core and double cover of inner cover covering the core and outer cover covering the inner cover, four piece solid golf ball with dual core and double cover covering the dual core, four piece solid golf ball with one core and triple cover covering the core, and four piece golf ball with a liquid core or a solid core on which rubber thread is wound and double cover over it. These various golf balls may have their own properties to be a good quality ball. However, it is actual that there is no golf ball to give a satisfaction to all golfers. A good golf ball is the one having a superior carry property and a proper spin property which is agreeable to the hitting feel. Accordingly, as a part of the efforts to make golf balls of these good properties, three piece solid golf ball with dual core and one cover covering the dual core and three piece solid golf ball with one core and double cover covering the core are being made in large quantities, that the production of the latter with higher productivity than the former is increasing nowadays. It is usual that inner cover of the latter be made harder than its outer cover to extend the carry by high repelling force in hitting the golf ball with a driver and to improve the spin property by relative softness of outer cover in hitting with an iron. The problem of this double cover is difficult to adjust properly the thickness of inner cover and outer cover having the physical properties different from each other. If making the soft outer cover thin, the golf ball may feel hard and its spin property also may fall off by relative hardness of inner cover in hitting, if making the outer cover thick in the other way, its hitting feel as well as spin property may get improved, but the repelling elasticity become lowered by the said softness to shorten the carry. A hard inner cover having more or less thickness to extend the carry by transmitting energy to core without diminution in hitting. That causes hard to make a golf ball in a good hitting feel. Additionally, there may occur a peel-off easily between two layers by frequent hitting due to the heterogeneity between two covers, that causes to get the repelling elasticity lowered, because both inner cover and outer cover have fixed thickness of their own and the contact area between two layers is not further extensible. Enlarging the contact area in bonding two layers of physical properties different from each other is the ordinary way to heighten adhesive strength. Thus, the present invention is to sove the problems mentioned above and provide a golf ball which has a higher resilience and a good spin property.

(Circles in this figure represent the shape of projections in cut sphere, and if using polygons in the other way, it represent the shape of projections which the bases are in polygon of various shapes. Meanwhile, if using polygons and circles together, it is possible to obtain a view in which the various projections are mixed).

FIG. 13 is a part of sectional view of the multilayer golf ball with projections on the surface of its inner cover according to the present invention, showing various shapes of projections at the inner cover that the top of projection is a cut plane and a space between projections is equal height to the bases of projections without concave, in the other way, the concave may be lower than the base of projections, or the bases of projections may be contact with each other. (Each core in this figure may be single core or dual core of inner core and outer layer. Each side of projections at inner cover can be in a shape of polygon, a section of sphere or round plane. Meanwhile, there are not seen the common dimples which are actually arranged on exterior surface of the outer cover covering the said inner cover for discriminating the projections of inner cover). FIG. 13 consists of FIGS. 13A through 13F.

FIG. 14 is a view of various projections at the inner cover according to the present invention, showing the projections seen from above and from the side, that, even though the bases in left and right views are the same shape, the side in the left view has a shape of round plane with no angle in case of the base be in polygon unlike its shape or a shape of round plane in case of the base be in circle, while the side in the right view has a shape of polygon in case of the base be in polygon or a shape of a part of cut sphere in case of the base be in circle. At the top of projections in the left view there is small dome or cut plane which is seen from above like circle, while in the right view there is only cut plane which is seen from above like polygon in case of the base be in polygon or like circle in case of the base be in circle. And it shows that the side or the top has the shape of a part of sphere in case of the projection be in dome whose top is not cut. FIG. 14 consists of FIGS. 14A through 14O.

Figure 15:
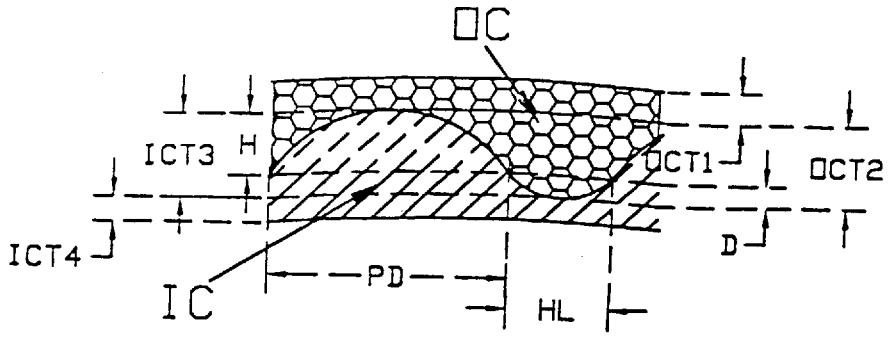

FIG. 15 is a view of a section of the inner cover having projections in sphere whose base is cut according to the present invention and of the outer cover covering the said inner cover (In this figure, there are not seen the common dimples which are actually arranged on exterior surface of the outer cover for discriminating the projections of inner cover. The followings are the same.), showing the measurement for the size and height of projections at the inner cover, the thickness of inner cover and outer cover, and the depth and size of concaves.

Figure 16:
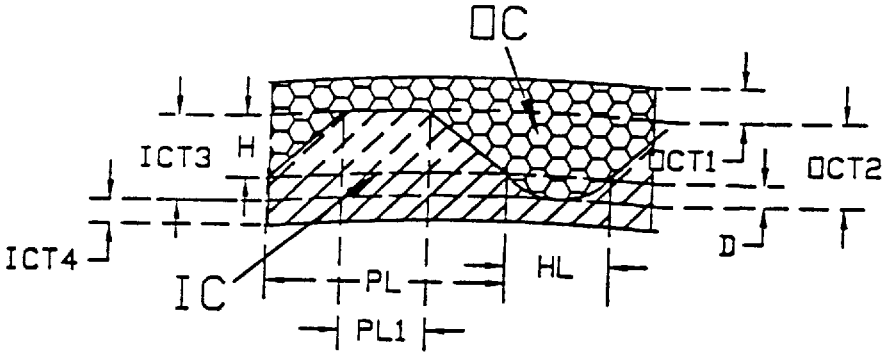

FIG. 16 is a view of a section of the inner cover having projections in dome whose top is cut, in polygon or in cone whose top is cut and of the outer cover covering the said inner cover, showing the measurement for the size and height of projections at the inner cover, the thickness of inner cover and outer cover, and the depth and size of concaves.

Figure 17:
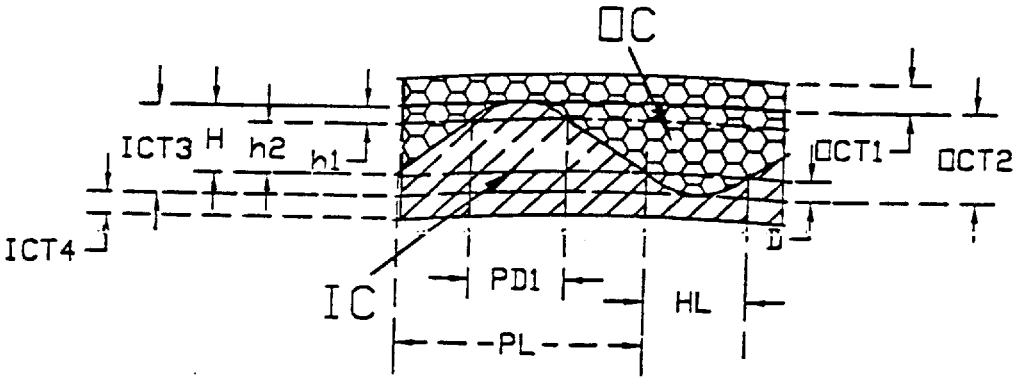

FIG. 17 is a view of a section of the inner cover having projections in shape of small dome placed on the plane whose top is cut in FIG. 16 and of the outer cover covering the said inner cover, showing the measurement for the size and height of projections at the inner cover, the thickness of inner cover and outer cover, and the depth and size of concaves.

DESCRIPTION OF THE MAIN PARTS IN DRAWINGS

Figure 1:
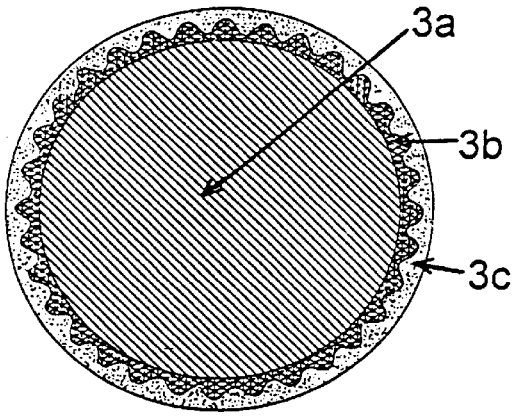
FIG. 1 is a sectional view of the golf ball that a core is covered with an inner cover having projections on its surface and also the said inner cover is covered with an outer cover. (There are not seen the common dimples which are actually arranged on exterior surface of the outer cover for discriminating the projections of inner cover. The followings are the same).

In FIG. 1 3*a* is inner core, 3*b* is inner cover having projections, 3*c* is outer cover having common dimples on its surface (Hereinafter represented just by outer cover).

Figure 2:
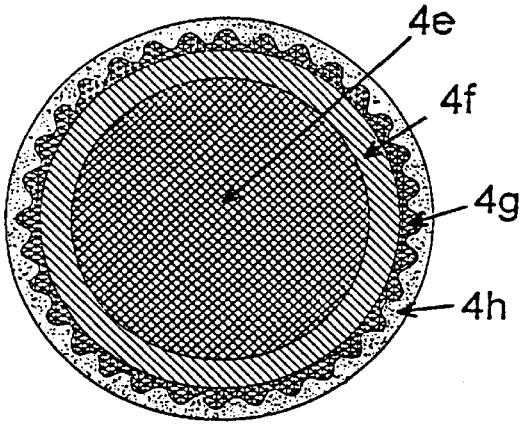
FIG. 2 is a sectional view of the golf ball that a core is covered with 1'st inner cover (a cover inside inner cover according to the present invention), the said 1'st inner cover is covered with an inner cover having projections on its surface according to the present invention, and the said inner cover is covered with an outer cover.

In FIG. 2 4*e* is core, 4*f* is 1'st inner cover, 4*g* is inner cover having projections, 4*h* is outer cover.

Figure 3:
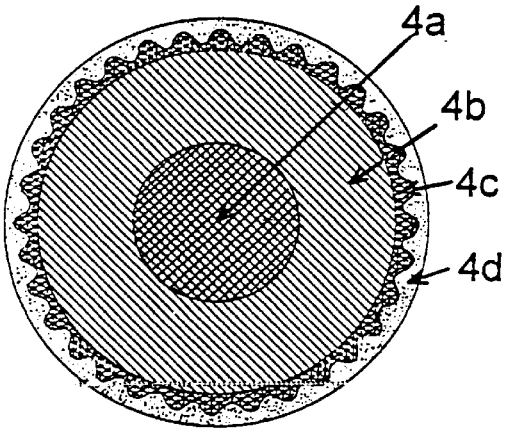
FIG. 3 is a sectional view of the golf ball that dual core of inner core and outer layer over the said inner core is covered with an inner cover having projections on its surface, and also the said inner cover is covered with an outer cover.

In FIG. 3 4*a* is inner core, 4*b* is outer layer, 4*c* is inner cover having projections, 4*d* is outer cover.

Figure 4:
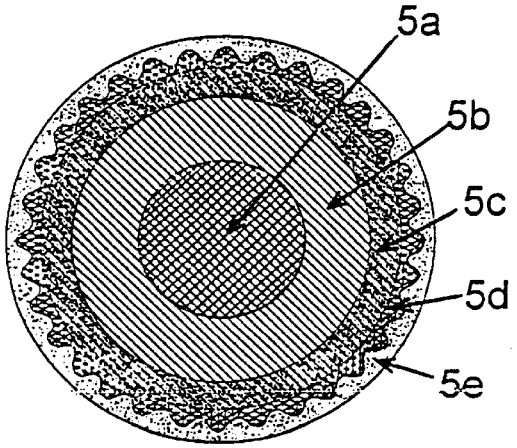
FIG. 4 is a sectional view of the golf ball that dual core of inner core and outer layer over the said inner core is covered with 1'st inner cover (a cover inside inner cover according to the present invention), the said 1'st inner cover is covered with an inner cover having projections on its surface according to the present invention, and the said inner cover is covered with an outer cover.

In FIG. 4 5*a* is inner core, 5*b* is outer layer, 5*c* is 1'st inner cover, 5*d* is inner cover having projections, 5*e* is outer cover.

Figure 5:
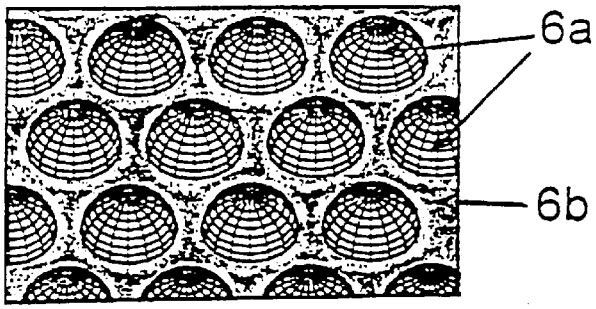
FIG. 5 is a three-dimensional representation of the surface of inner cover having projections in part, that there are seen the projections in a form of cut sphere (dome), as an example of various projections, and concave(hollow and sunken part) shown in some black in the flat between projections.

In FIG. 5 6*a* is projection in cut sphere (dome) which is three-dimensionally represented on the surface of inner cover, 6*b* is flat between projections.

Figure 6:
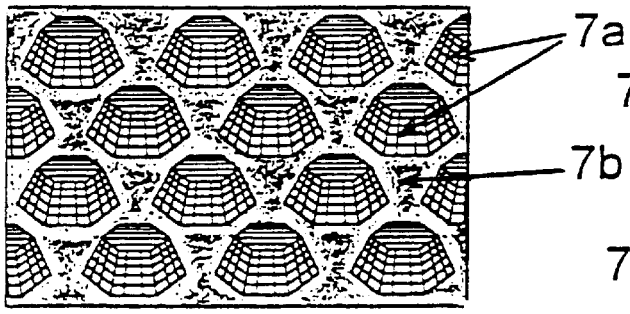
FIG. 6 is a representation in the same way as FIG. 5, showing projections in a form of polyhedron, as an example of various projections, with the base in hexagon and the top in hexagon smaller than the base.

In FIG. 6 7*a* is projection in polyhedron which is three-dimensionally represented on the surface of inner cover, 7*b* is flat between projections.

Figure 7:
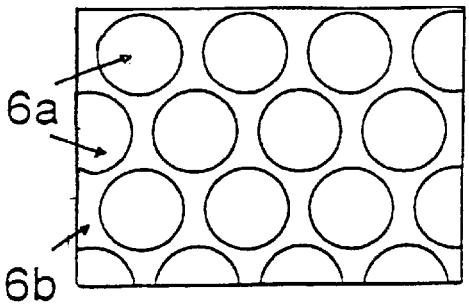
FIG. 7 is a plane representation of FIG. 5, showing dome-shaped projections which are made just in circle of the base. (It is notable that projections of the inner cover according to the present invention be arranged and represented just in a shape of the base of the projection thereof. The followings are the same).

In FIG. 7 a figure of plane representation of FIG. 5, 6*a* corresponding to 6*a* in FIG. 5, 6*b* corresponding to 6*b* in FIG. 5.

Figure 8:
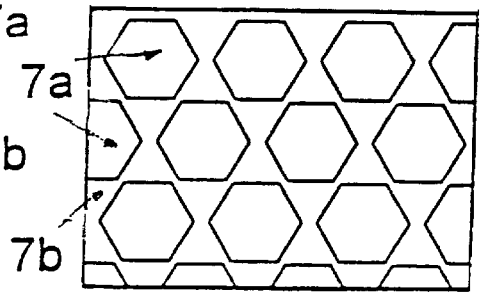
FIG. 8 is a plane representation of FIG. 6, showing polyhedron-shaped projections which are made just in hexagon of the base.

In FIG. 8 a figure of plane representation of FIG. 6. 7*a* corresponding to 7*a* in FIG. 5, 7*b* corresponding to 7*b* in FIG. 6.

Figure 9:
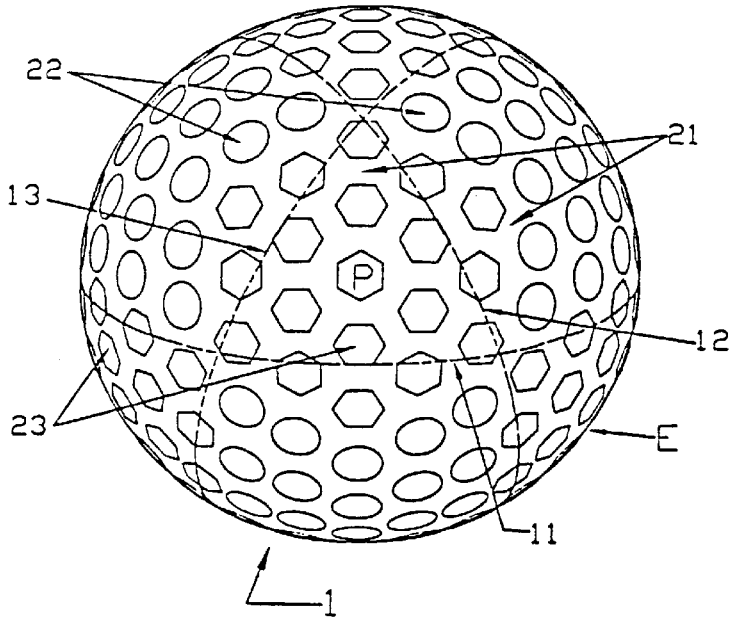
FIG. 9 is a representation showing an arrangemant of projections at the inner cover according to the present invention by dividing sphere's surface into a spherical polyhedron, especially into a spherical cube-octahedron, one of the compositions to divide sphere's surface, that there are seen some projections of a shape showing up at one part and some projections of different shape showing up at another part by part on the surface of inner cover according to the shape of projections. (In this figure, a shape of various projections in cut sphere is represented just by circles and a shape of various projections in polyhedron, in the base of polygon and the side and top of non-polygon, or in the base and side of polygon and the top of cut sphere is represented just by polygons).

In FIG. 9 1 is a surface of inner cover having projections that each base is in circle and in polygon gathered partially, 11,12,13 is dividing lines of sphere to arrange the projections on the surface of inner cover (dividing lines of spherical cube-octahedron in this figure), P is pole, E is equator, 21 is flat between projections, 22 is projection whose base is in circle, 23 is projection whose base is in polygon.

Figure 10:
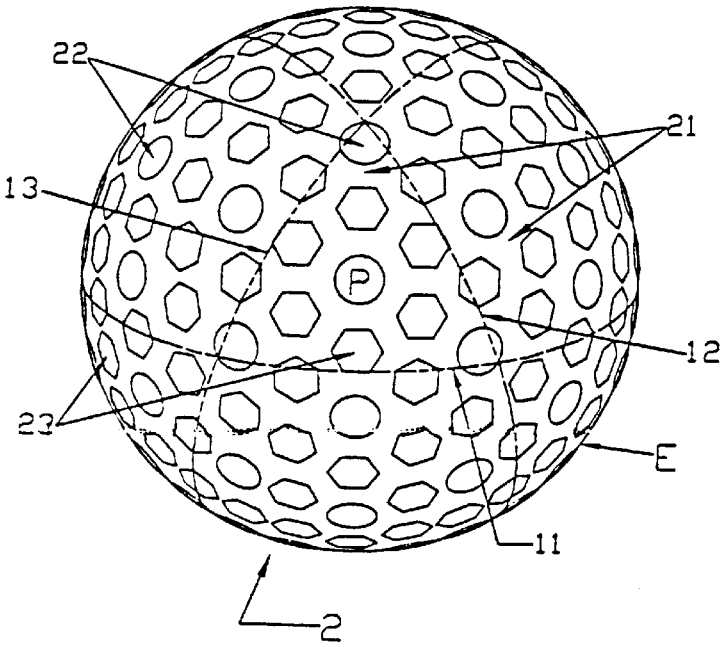
FIG. 10 is a representation showing an arrangemant of projections at the inner cover according to the present invention by dividing sphere's surface into a spherical cube-octahedron like FIG. 9, that there are seen some projections of a shape arranged with getting scattered and mixed within other projections of different shape at each part on the surface of inner cover according to the shape of projections. (The circle and polygon concept in this figure is the same as explained in FIG. 9).

In FIG. 10 2 is a surface of inner cover having projections that each base is in circle and in polygon mixed evenly, 11,12,13 is dividing lines of sphere to arrange the projections on the surface of inner cover (dividing lines of spherical cube-octahedron in this figure), P is pole, E is equator, 21 is flat between projections, 22 is projection whose base is in circle, 23 is projection whose base is in polygon.

Figure 11:
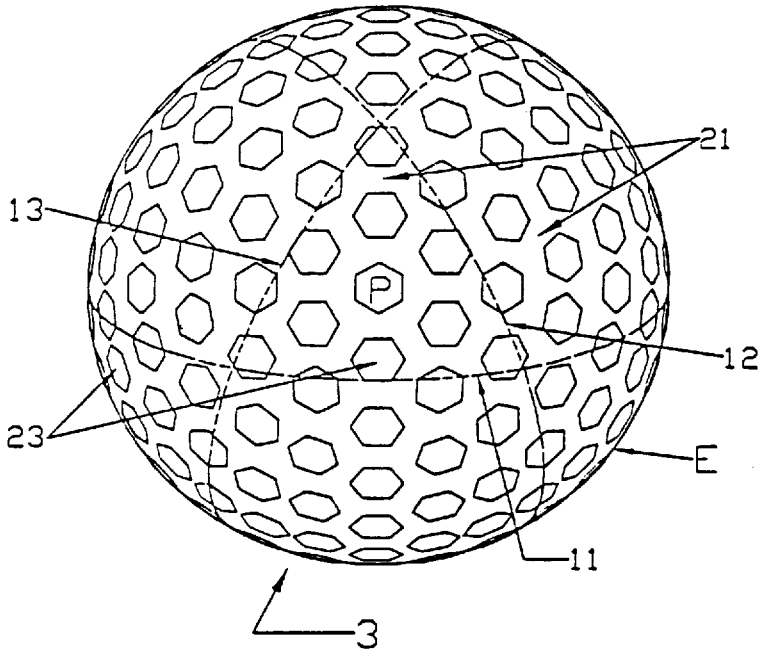
FIG. 11 is a representation showing an arrangemant of projections at the inner cover according to the present invention by dividing sphere's surface into a spherical cube-octahedron like FIG. 9, that there are seen polyhedron-shaped projections. (The polygon concept in this figure is the same as explained in FIG. 9. When arranging projections by dividing the surface of inner cover, it is possible to arrange in various spherical polyhedrons such as spherical icosahedron, spherical icosidodecahedron, spherical dodecahedron, spherical octahedron, etc. in addition to spherical cube-octahedron referred above that is represented just as an example of arrangement in this figure).

In FIG. 11 3 is a surface of inner cover having same kind of projections that each base is in polygon, 11,12,13 is dividing lines of sphere to arrange the projections on the surface of inner cover (dividing lines of spherical cube-octahedron in this figure), P is pole, E is equator, 21 is flat between projections, 23 is projection whose base is in polygon.

Figure 12:
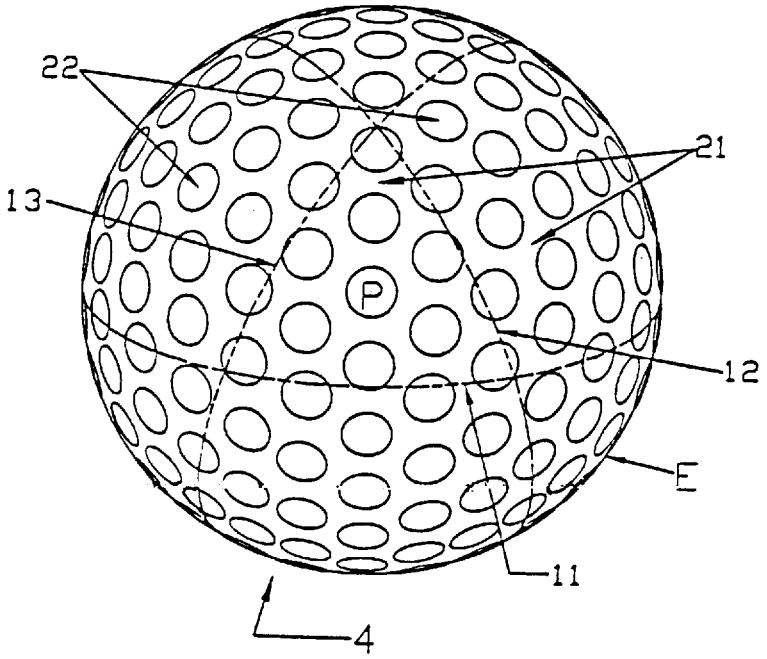
FIG. 12 is a representation in the same way as FIG. 11, showing cut sphere shaped projections. (The circle concept in this figure is the same as explained in FIG. 9. When arranging projections by dividing the surface of inner cover, it is possible to arrange in various spherical polyhedrons such as spherical icosahedron, spherical icosidodecahedron, spherical dodecahedron, spherical octahedron, etc. in addition to spherical cube-octahedron referred above that is represented just as an example of arrangement in this figure).

In FIG. 12 4 is a surface of inner cover having same kind of projections that each base is in circle, 11,12,13 is dividing lines of sphere to arrange the projections on the surface of inner cover (dividing lines of spherical cube-octahedron in this figure), P is pole, E is equator, 21 is flat between projections, 22 is projection whose base is in circle.

Figure 12A:
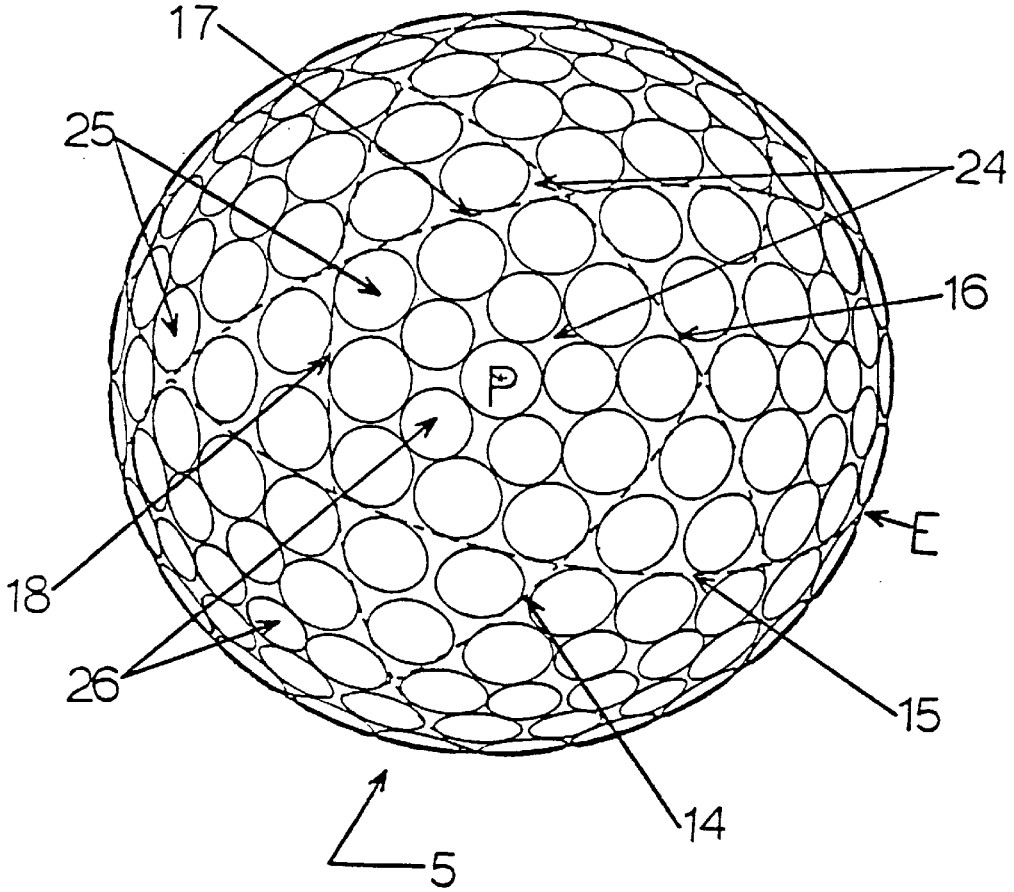
FIG. 12A is a representation showing an arrangemant of projections at the inner cover according to the present invention by dividing sphere's surface into a spherical icosi-dodecahedron, that the projections have more than two sizes, and some projections contacting with each other at the periphery of bases and some projections apart from each other at the periphery of bases.
Figure 13A:
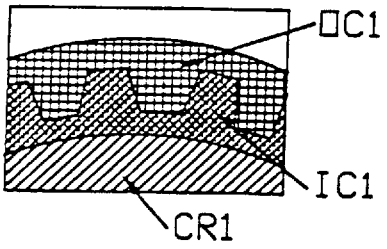
Figure 13B:
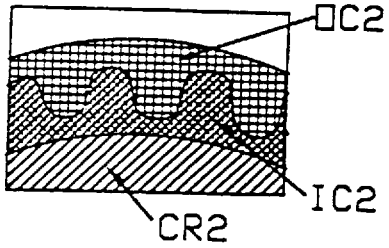
Figure 13C:
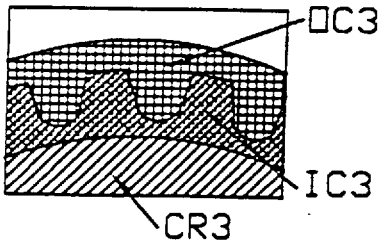
Figure 13D:
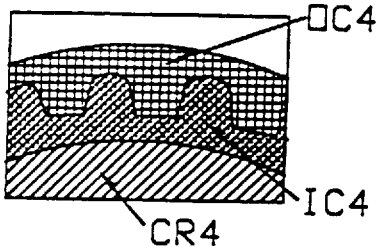
Figure 13E:
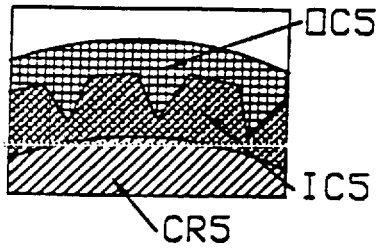
Figure 13F:
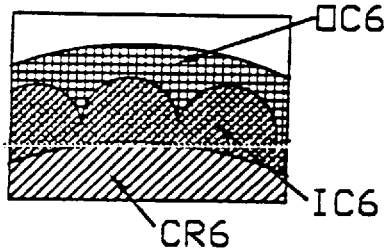
Figure 14A:
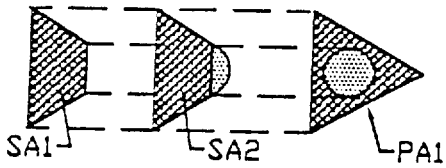
Figure 14C:
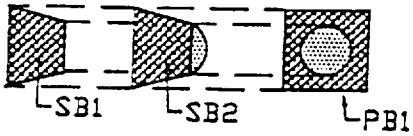
Figure 14E:
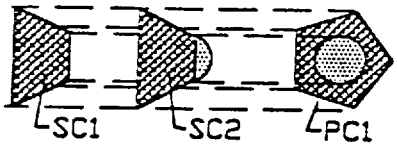
Figure 14G:
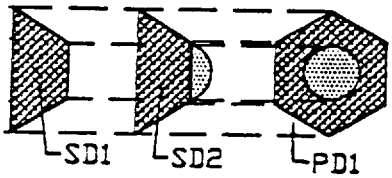
Figure 14I:
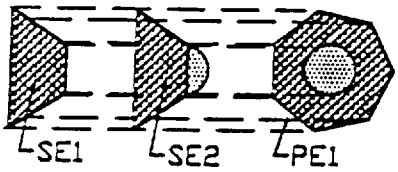
Figure 14K:
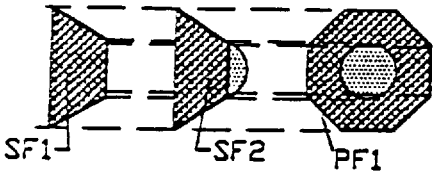
Figure 14M:
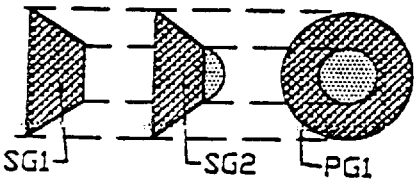
Figure 14O:
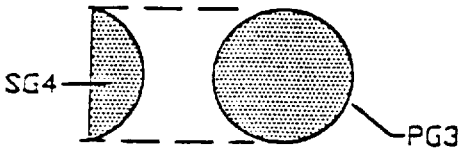
Figure 14B:
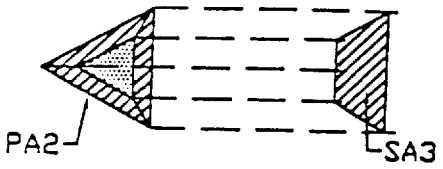
Figure 14D:
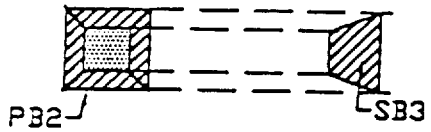
Figure 14F:
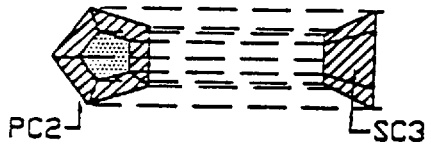
Figure 14H:
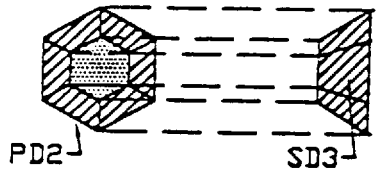
Figure 14J:
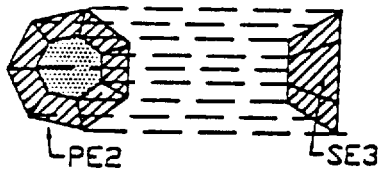
Figure 14L:
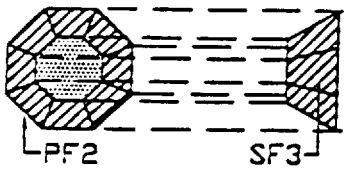
Figure 14N:
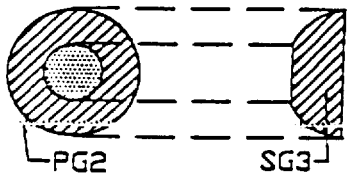

In FIG. 12A is a surface of inner cover having various sized projections mixed together that are in contact with or apart from each other (the projection shown in this figure by circle can be represented in polyhedron if the base be in polygon.), P is pole, E is equator, 14,15,16,17,18, is dividing lines of sphere to arrange the projections on the surface of inner cover (dividing lines of spherical icosi-dodecahedron), 24 is flat between projections, 25 is larger projection, 26 is smaller projection.

In FIG. 13 CR1,CR2,CR3,CR4,CR5,CR6 are parts of section of core or dual core, IC1 is a part of inner cover having projections in polyhedron with no concave of the hollow flat between projections or in cone whose top is cut, OC1 is a part of outer cover, IC2 is a part of inner cover having projections in polyhedron that its top is in small dome with concave of the hollow flat between projections or in sphere that its base is cut, OC2 is a part of outer cover, IC3 is a part of inner cover having projections in polyhedron with concave of the hollow flat between projections or in cone whose top is cut, OC3 is a part of outer cover, IC4 is a part of inner cover having projections in polyhedron that its top is in small dome with no concave of the hollow flat between projections or in sphere whose base is cut, OC4 is a part of outer cover, IC5 is a part of inner cover having polyhedron-shaped projections that are in contact with each other without flat between projections or in cone whose top is cut, OC5 is a part of outer cover, IC6 is a part of inner cover having projections in sphere whose base is cut that are in contact with each other without flat between projections, OC6 is a part of outer cover.

In FIG. 14 SA1 is a side of projection that base is in triangle and its top is cut cone, SA2 is a side of projection with a small dome put on the top of SA1, PA1 is a figure of projection with the side of SA1 or SA2 that is viewed from above, SA3 is a side of polyhedron-shaped projection that its base is in triangle and its top is in smaller triangle, PA2 is a figure of projection with the side of SA3 that is viewed from above, SB1 is a side of projection that its base is in tetragon and its top is cut cone, SB2 is a side of projection with a small dome put on the top of SB1, PB1 is a figure of projection with the side of SB1 or SB2 that is viewed from above, SB3 is a side of polyhedron-shaped projection that its base is in tetragon and its top is in smaller tetragon, PB2 is a figure of projection with the side of SB3 that is viewed from above, SC1 is a side of projection that its base is in petagon and its top is cut cone, SC2 is a side of projection with a small dome put on the top of SC1, PC1 is a figure of projection with the side of SC1 or SC2 that is viewed from above, SC3 is a side of polyhedron-shaped projection that its base is in petagon and its top is in smaller petagon, PC2 is a figure of projection with the side of SC3 that is viewed from above, SD1 is a side of projection that its base is in hexagon and its top is cut cone, SD2 is a side of projection with a small dome put on the top of SD1, PD1 is a figure of projection with the side of SD1 or SD2 that is viewed from above, SD3 is a side of polyhedron-shaped projection that its base is in hexagon and its top is in smaller hexagon, PD2 is a figure of projection with the side of SD3 that is viewed from above, SE1 is a side of projection that its base is in heptagon and its top is cut cone, SE2 is a side of projection with a small dome put on the top of SE1, PE1 is a figure of projection with the side of SE1 or SE2 that is viewed from above, SE3 is a side of polyhedron-shaped projection that its base is in heptagon and its top is in smaller heptagon, PE2 is a figure of projection with the side of SE3 that is viewed from above, SF1 is a side of projection that its base is in octagon and its top is cut cone, SF2 is a side of projection with a small dome put on the top of SF1, PF1 is a figure of projection with the side of SF1 or SF2 that is viewed from above, SF3 is a side of polyhedron-shaped projection that its base is in octagon and its top is in smaller octagon, PF2 is a figure of projection with the side of SF3 that is viewed from above, SG1 is a side of projection that its base is in circle and its top is cut cone, SG2 is a side of projection with a small dome put on the top of SG1, PG1 is a figure of projection with the side of SG1 or SG2 that is viewed from above, SG3 is a side of projection that its base is in cut dome, PG2 is a figure of projection with the side of SG3 that is viewed from above, SG4 is a side of projection in dome, PG3 is a figure of projection in dome that is viewed from above.

In FIG. 15 IC is an inner cover having projection in dome or in cut sphere, OC is an outer cover, H is the height of projection in dome or in cut sphere, PD is the length or diameter of the base of projection, HL is the length or diameter of the concave of hollow flat between projections, D is the depth of the said concave, OCT1 is the thickness of outer cover from the top of projection to the exterior surface of outer cover, OCT2 is the thickness of outer cover from the top of projection to the bottom of concave between projections, ICT3 is the thickness of inner cover from the top of projection to the bottom of concave between projections, ICT4 is the thickness of inner cover from the bottom of concave between projections to the surface of core or outer layer of dual core.

In FIG. 16 IC is an inner cover having projections that each base is in polygon or in circle and each top is in cut cone or in small polygon, OC is an outer cover, H is the height of the said projection, PL is the length or diameter of the base of projection, PL1 is the length or diameter of the top of projection, HL is the length or diameter of concave of the hollow flat between projections, D is the depth of the said concave, OCT1 is the thickness of outer cover from the top of projection to the exterior surface of outer cover, OCT2 is the thickness of outer cover from the top of projection to the bottom of concave between projections, ICT3 is the thickness of inner cover from the top of projection to the bottom of concave between projections, ICT4 is the thickness of inner cover from the bottom of concave between projections to the surface of core or outer layer of dual core.

In FIG. 17 IC is an inner cover having projections that each base is in polygon or in circle and a small dome is put on each top, OC is an outer cover, H is the height of the said projection, h1 is the height of small dome on the top of projection, h2 is the height obtained by subtracting h1 from H, PL is the length or diameter of the base of projection, PD1 is the diameter of base in the said small dome on the top of projection, HL is the length or diameter of concave of the hollow flat between projections, D is the depth of the said concave, OCT1 is the thickness of outer cover from the top of projection to the exterior surface of outer cover, OCT2 is the thickness of outer cover from the top of projection to the bottom of concave between projections, ICT3 is the thickness of inner cover from the top of projection to the bottom of concave between projections, ICT4 is the thickness of inner cover from the bottom of concave between projectons to the surface of core or outer layer of dual core.

DETAILED DESCRIPTION OF THE INVENTION

Core and dual core for the solid multilayer golf ball, or liquid core and solid core for the rubber thread wound golf ball according to the present invention is made by common way that materials, compositions or production methods thereof are not limited in general. Accordingly, core in inner cover according to the present invention which is made by common way is in use. The main materials of inner cover having projections on its surface according to the present invention are organic polymeric materials to which pigments for coloring, fillers for weighting, anti-oxidants (ageing registers) are added in some cases. All organic polymeric materials such as natural rubber, synthetic rubber, polyurethane resin, thermoplastic polyetherester resin, ionomer resin, thermoplastic nylon resin, etc. which are in actual use for cover can be applied. Of the aforementioned resins, rubber is used in a mixture with various crosslinking agents to crosslink and vulcanize the rubber, reacting initiator and other additives. Any of polyurethane resins in two component type or thermoplastic one component type is usable. Ionomer resins can be applied regardless of the kind of ion or unsaturated carboxylic acid. These various resins may be used alone or in a mixture of more than two kinds in some cases. When covering over a core or dual core or 1'st inner cover with the resin compositions stated above, it is needed to form by molding method of injection molding, compression molding or extrusion molding. Meanwhile, in designing projections on the surface of inner cover according to the present invention, it is need to begin with dividing its surface into spherical polyhedron or by fixed angle and distance to arrange properly the position and size of projections. This is because well-balanced arrangement of projections gets constant energy transmitted to any part of the golf ball in hitting and it is to have an effect in the aerodynamic stability. Spherical polyhedrons such as spherical hexahedron, spherical octahedron, spherical dodecahedron, spherical icosahedron, spherical cube-octahedron, spherical icosidodecahedron or other variants of the said polyhedrons are applicable for dividing the surface of inner cover. When arranging projections by dividing the surface of inner cover in this way, it is essential to divide into equal parts of all the inner cover so that the projections in each polyhedron or in angle and distance can keep the balance in size, interval or height in every position with each other. The flats may be formed between projections that are apart from each other as shown in FIG. 9, FIG. 10, FIG. 11 and FIG. 12, while some projections have no flats in contact with each other and some are apart from each other in FIG. 12A. In FIG. 13, the flat has a fixed sides or the concave of the hollow between projections. Projections have many shapes as said earlier in the description of the drawings. It is desirable to choose the shape in accordance with the kind of resins to use or the size of projection, not too small or large. With too small projection it makes difficult to obtain satisfactory effects according to the present invention, on the contrary, with too large one, the inner cover becomes too thick accordingly to lead to a bad result. If projection has the side too narrow, a transmitting energy will be insufficient in hitting, on the contrary, if too wide it is difficult to have an expected property under no influence of the outer cover of golf ball. HL of a measurement showing the correlation of inner cover with outer cover in FIG. 15, FIG. 16 and FIG. 17, which is the length of flat between projections, and it is presumable that there be a flat with HL over 0 or no flat between projections in contact with each other with HL of 0. D, depth of the concave of flat, being over 0 means that the flat has a deep concave or D of 0 tells the fact that the flat is plane with no concave. As for the thickness of outer cover, it is desirable to adjust OCT1, height from the top of projection to the surface of outer cover in FIG. 15, FIG. 16 and FIG. 17, of 0.2 mm to 2 mm, that outer cover of the corresponding region in hitting may be easy to tear or get damaged if not more than 0.2 mm and, if not less than 2 mm, no result according to the present invention will be obtained under the increase in influence of outer cover of the corresponding region. H, height of projection, is to be set with regard to a balance in the thickness of all inner cover and outer cover and H of 0.2 mm to 3 mm is proper, that projections may become useless if not more than 0.2 mm and if not less than 3 mm, inner cover and outer cover may become too thick to have an effect of repelling elasticity of core and to extend a carry, and causing a bad result is inevitable because the efficiency of golf ball is influenced by physical properties of inner cover. ICT4 in FIG. 15, FIG. 16 and FIG. 17, thickness from the surface of core or dual core or 1'st inner cover to the base of flat or the bottom of concave between projections, is desirable to adjust by 0.2 mm to 2 mm, that core or dual core or 1'st inner cover between inner cover having projections peel-off easily in hitting the golf ball to get energy diminished if not more than 0.2 mm, and if not less than 2 mm, inner cover becomes too thick, with the result that the golf ball may be unpleasant to the touch. In the meantime, inner cover according to the present invention is to be covered with outer cover formed with the same resin compositions as other common outer covers, that is, the aforementioned resin compositions usable for the said inner cover, by ordinary method of injection molding, compression molding or extrusion molding. The important thing for covering and forming the outer cover is a vacuum forming with a proper apparatus to prevent any gas like air from inserting between the outer cover and inner cover having projectins. When making a golf ball with inner cover having projections on the surface designed as above, inner cover and outer cover made of the same resin compositions are desirable to have a different hardness. If the inner cover and outer cover having a same hardness of the same resin compositions, it is difficult to make an advantage of the present invention as it have. In some cases, it is possible to form a thin layer of the same resin compositions or other resin compositions to increase the adhesive strength between outer cover and inner cover, or between core or dual core or 1'st inner cover and inner cover having projectins. The golf ball according to the present invention made by method as above is the one that the energy in hitting with a driver is transmitted fast to core or dual core or 1'st inner cover by projections on the surface of inner cover to grow repelling elasticity higher, so as to make a carry much farther than other common golf balls do and also have a good spin property by the said projections.

What is claimed is:

1. A multilayer golf ball comprising:

(a) an inner cover defining an interior surface, an exterior surface, and projections on said exterior surface of said inner cover; and (b) an outer cover defining an interior surface, an exterior surface, and dimples on said interior surface of said outer cover;

said dimples being configured and dimensioned to matingly receive therein said projections.

2. The golf ball of claim 1, wherein said golf ball is one of:

a three piece solid golf ball comprising a core and double cover, said double cover being composed of an inner cover having projections and an outer cover covering said inner cover;

a four piece solid golf ball comprising a dual core and double cover, said dual core being composed of an inner core and an outer layer covering said inner core, and said double cover being composed of an inner cover having projections and an outer cover covering said inner cover;

a four piece golf ball comprising a liquid center, a rubber thread wound about said liquid center, an inner cover covering said rubber thread layer and having projections, and an outer cover covering said inner cover;

a four piece golf ball comprising a solid core, a rubber thread wound about said solid core, an inner cover covering said rubber thread layer and having projections, and an outer cover covering said inner cover;

a four piece solid golf ball comprising a core and triple cover, said triple cover being composed of a first inner cover covering said core, an inner cover covering said first inner cover and having projections, and an outer cover covering said inner cover; and a five piece solid golf ball comprising a dual core and triple cover, said dual core being composed of an inner core and an outer layer covering said inner core, and said triple cover being composed of a first inner cover covering said dual core, an inner cover covering said first inner cover and having projections, and an outer cover covering said inner cover.

3. The golf ball of claim 1, where the entire exterior surface of said inner cover is divided into said projections.

4. The golf ball of claim 1, wherein the exterior surface of said inner cover defines projections, each said projection having a top, a base and sides connecting said top and said base, said projections being:

(a) projections in the form of spheres;

(b) projections in the form of spheres with cut bases;

(c) projections in the form of polyhedrons;

(d) projections in the form of spherical polyhedrons;

(e) projections wherein said bases are polygonal and said sides are round and planar;

(f) projections wherein said bases are circular and said sides are round and planar;

(g) projections wherein said bases are polygonal and said sides are round and planar, with a small dome on each top thereof;

(h) projections wherein said bases are polygonal and said sides are polygonal, with a small dome on each top thereof;

(i) projections wherein said bases are circular and said sides are round and planar, with a small dome on each top thereof;

(j) projections wherein said bases and said tops are sphere segments; and (k) combinations of at least two of said projections.

5. The golf ball of claim 1, wherein said projections are apart from each other and define a flat between said projections on the exterior surface of said inner cover, said flat being plane or concave.

6. The golf ball of claim 5, wherein the thickness from the exterior surface of an included core or dual core or first inner cover to an included base or bottom of said flat between said projections is 0.2 mm to 2 mm.

7. The golf ball of claim 1, wherein said projections are in contact with each other and have no flat between said projections on the exterior surface of said inner cover.

8. The golf ball of claim 1, having projections on the exterior surface of said inner cover, some of said projections being in contact with each other and some of said projections being apart from each other.

9. The golf ball of claim 1, wherein the thickness of said inner cover having projections on its exterior surface is 0.2 mm to 4 mm.

10. The golf ball of claim 1, wherein the thickness of said outer cover having said dimples on its interior surface is 0.2 mm to 4 mm.

11. The golf ball of claim 1, wherein the height of said projections on the exterior surface of said inner cover is 0.2 mm to 3 mm.

12. The golf ball of claim 1, wherein the height from the top of said projections to the interior surface of said outer cover is 0.2 mm to 2 mm.

13. The golf ball of claim 1, wherein and said inner cover and said outer cover are separately formed.

14. The golf ball of claim 1 having projections on the exterior surface of said inner cover, some of said projections being of equal size to each other and some of said projections being of different sizes relative to each other.

* * * * *

UNITED STATES PATENT AND TRADEMARK OFFICE

CERTIFICATE OF CORRECTION

PATENT NO. : 5,820,485
DATED : October 13, 1998
INVENTOR(S) : In Hong Hwang

It is certified that error appears in the above-indentified patent and that said Letters Patent is hereby corrected as shown below:

On the title page, item [54] and col. 1, line 2: delete "OR" and add -- OF --.

Signed and Sealed this

Twenty-third Day of February, 1999

*Attest:*

Q. TODD DICKINSON

*Attesting Officer*

*Acting Commissioner of Patents and Trademarks*